United States Patent [19]

Wagner

[11] Patent Number: 5,000,108

[45] Date of Patent: Mar. 19, 1991

[54] WISHBONE-BOOM FRONT PIECE FOR FASTENING A WISHBONE BOOM TO THE MAST OF A SURFBOARD

[75] Inventor: Eckart Wagner, Niederpöcking, Fed. Rep. of Germany

[73] Assignee: North Sails Windsurfing GmbH, Penzberg, Fed. Rep. of Germany

[21] Appl. No.: 396,994

[22] Filed: Aug. 22, 1989

[30] Foreign Application Priority Data

Aug. 28, 1988 [DE] Fed. Rep. of Germany ... 8810870[U]
Jun. 19, 1989 [DE] Fed. Rep. of Germany ... 8907449[U]
Jul. 1, 1989 [DE] Fed. Rep. of Germany ... 8908047[U]

[51] Int. Cl.[5] ..... B63B 15/00
[52] U.S. Cl. ..... 114/98; 114/39.2
[58] Field of Search ..... 114/39.2, 97, 98, 99, 114/102; 248/74.1

[56] References Cited

U.S. PATENT DOCUMENTS 4,587,916 5/1986 Guerette ..... 114/98
4,782,780 11/1988 Smith ..... 114/98
4,878,448 11/1989 Schutz ..... 114/98

FOREIGN PATENT DOCUMENTS 7934981 3/1980 Fed. Rep. of Germany .
8301796 7/1983 Fed. Rep. of Germany .
8504545 6/1985 Fed. Rep. of Germany .
3404622 8/1985 Fed. Rep. of Germany .
3411042 10/1985 Fed. Rep. of Germany .
3615966 11/1987 Fed. Rep. of Germany .
2621881 4/1989 France .
664124 2/1988 Switzerland .

*Primary Examiner*—Joseph F. Peters, Jr.
*Assistant Examiner*—Jesûs D. Sotelo
*Attorney, Agent, or Firm*—Juettner Pyle Lloyd & Verbeck

[57] ABSTRACT

A device for attaching the boom to different diameter masts includes a lever attached to a locking pin, which is received in a number of slots to enable circumferential adjustment.

19 Claims, 6 Drawing Sheets

WISHBONE-BOOM FRONT PIECE FOR FASTENING A WISHBONE BOOM TO THE MAST OF A SURFBOARD

This invention relates to wishbone-boom front piece comprising a mast sleeve which surrounds the mast and, for the purpose of adaptation to different mast diameters, has two ends which face each other and are connectable at a selected distance from each other by a lever means hinged to one end of the mast sleeve.

The mast sleeve is provided with a fixing device which in the selected in-use position of the wishbone boom puts the mast sleeve into a non-displaceable clamping seat on the mast. Said fixing device is a cam which is connected to the wishbone-boom head piece and which when the wishbone boom is pivoted out of a position parallel or acute-angled to the mast into the in-use position, passes through a window in the sleeve and is pressed against the mast, with an elastic insert being interposed, in such a way that the most sleeve is moved into the non-displaceable seat.

The fixing device must be adapted to the respective mast diameter so that is can produce the firm clamping set of the sleeve. This is accomplished through the lever means by which the opposite lateral ends of the mast sleeve are connectable at a variable distance from each other.

It is one object of the present invention to provide a wishbone-boom front piece comprising a mast sleeve which can be adapted to different mast diameters in a fast and easy way. It is thereby to be insured that the mast sleeve reliably withstands all loads arising and that the sleeve ends to be connected cannot slip relative to each other.

To reduce the risk of damage to the mast by a mast sleeve of the type considered, it is furthermore known that an inner sleeve which is to prevent great pointwise or linear compressive stresses and distributes the arising forces over a greater mast surface is disposed inside the sleeve consisting of a relatively rigid material. When such an inner sleeve is made of a rigid plastic material, it can effectively prevent the compression peaks, but it requires a relatively great force to bring the sleeve into a non-displaceable seat on the mast because the friction between such an inner sleeve and the mast is low.

There has already been suggested an inner sleeve closed in hose-like fashion and consisting of rubber, wherein the advantage of a great friction is made use of so that a relatively small clamping force is here sufficient to fasten the sleeve in a non-displaceable manner to the mast. However, the great friction existing between the inner rubber sleeve and the mast has here the disadvantage that the axial position of the sleeve on the mast is only variable by applying a relatively great force because the hose-like rubber sleeve which closely surrounds the mast can only be displaced with difficulty along the mast. On the other hand, when a considerable interspace remains between the hose-like inner rubber sleeve and the exterior surface of the mast, which may be the case with a higher fastening position of the wishbone boom due to the slightly conical form of the mast, it might happen that the clamping effect is considerably decreased by water which has penetrated into the interspace. Likewise, grains of sand which have entered thereinto can be also impair the clamping effect and damage the normally existing anodized protective layer of the mast.

It is another object of the invention to provide a wishbone-boom front piece comprising a mast sleeve which can be brought into a firm clamping seat by applying a relatively small force and which, nevertheless, is relatively easily displaceable in axial direction along the mast when the clamping seat of the sleeve is loosened. Moreover, disadvantageous effects of water and/or sand which has penetrated into the interior of the sleeve are mainly to be prevented thereby.

A mast sleeve of the type in question is fixedly clamped around the mast in the closing position so that the sleeve is non-displaceably seated on the mast. When there is a sleeve clamped in this way, the same springs open suddenly when the lever is moved from the closing position into the opening position. Therefore, with conventional mast sleeves it is in general more or less impossible to change the axial position on the mast on water, for instance in order to be able to adapt the rig optimally to the respective wind conditions without loosing too much time, because after the sleeve has sprung open, the wishbone boom is practically no longer retained on the mast.

It is another object of the present invention to provide a wishbone-boom front piece comprising a mast sleeve whose internal dimensions can be enlarged such that the mast sleeve is reliably prevented from springing open.

According to one aspect of the invention the lever means of the mast sleeve includes a first lever which is pivotable about a position parallel to the longitudinal axis of the mast sleeve and comprises at least one locking pin in the area of its free end. The other end of the mast sleeve is provided with a receiving means for said at least one locking pin, the receiving means including a plurality of receiving openings which are spaced from each other in the circumferential direction of the mast sleeve and preferably offer two or three different possibilities of adjusting the mast sleeve.

The at least one locking pin is fastened to the lever such that it projects with a respective locking portion in both axial directions. To receive the protruding locking portions, the receiving means connected to the other end of the mast sleeve has formed thereon strips which are spaced from each other axially, i.e. in the direction of the mast axis, and extend in the circumferential direction of the mast sleeve and which include aligned receiving grooves for the locking portions with which the different sleeve widths can be adjusted.

The dimensions should be chosen such that the locking portions of the at least one locking pin can be accommodated in the receiving grooves such that the head ends of the locking portions are in contact with the groove bottoms substantially without any axial play so that axial displacement are made impossible. In addition thereto, or instead thereof, the lateral edges of the lever facing the strips can substantially rest against the strips in the locking position, whereby any axial displacement between the receiving means and the lever is excluded.

Starting from their radial outer entrance opening, the receiving grooves obliquely extend in the direction of the end of the mast sleeve provided at the lever side. With this construction the at least one locking pin of the lever must only be inserted into the upper portion of the receiving grooves, whereupon, when the lever means is closed, the pin is reliably drawn into the end position of the receiving grooves in which the closing position is secured by virtue of the oblique course of the receiving grooves.

Moreover, for the reception of the locking pin or of two locking pins aligned with each other, there are additionally provided relatively elongated webs which are centrally formed between the two strips on the receiving means and which define receiving grooves that are in alignment with the associated receiving grooves of the strips. Either the middle portion of the common locking pin or the centrally opposite locking portions of two aligned locking pins are accommodated in these elongated receiving grooves, whereby a very stable engagement is achieved. The last-mentioned version in the case of which the locking pin is centrally separated is preferred because of the improved force distribution. In a preferred embodiment the first lever comprises three parallel, evenly spaced-apart fastening arms which are pivotally hinged about a common axis to another lever which is preferably provided with bent grip portions and which is, for its part, supported on the mast sleeve. The fastening arms are here integrally connected through a connection portion to the two retaining arms which should also extend parallel to each other and which retain the locking pin(s) at their free end portions.

As far as the wishbone-boom front piece of the invention is concerned, the locking pin accommodated in the receiving opening or openings guarantees a solid connection of the two sleeve ends, the latter being immovably held relative to each other in the axial direction as well. The connection is firm and fully reliable.

According to another aspect of the present invention the mast sleeve of the wishbone-boom front piece has at least one circumferential portion of its inner surface provided with an elastic insert whose inner surface which faces the mast comprises recesses. As a result of this surface structure of the elastic insert, penetrating water is displaced into the cavities, whereby the contact between the portion or portions provided with the recesses and the circumferential surface of the mast is considerably improved. Sand present between mast and sleeve can be received by the cavites in a similar way so that an impairment of the clamping effect due to sand grains, as well as damage to the outer surface of the mast are prevented.

Furthermore, the surface structure has the effect that when the sleeve is moved into the clamping seat, increased pointwise or linear contact forces from the elastic insert fastened to the inner surface of the sleeve act on the mast so that a smaller force is required for moving the sleeve into the non-displaceable seat. Preferably small webs which as a result of the elasticity of the material are moreover not harmful to materials as they create a buffering effect remain between the recesses provided in the inner surface of the elastic insert. In addition the insert can be relatively thick in the area of its surface structure because the elastic webs can be deformed to a considerable extent by the application of a relatively small force so that relatively great differences between mast diameters can be offset.

Another result of the surface structure is that after the clamping seat of the sleeve has been released, for instance as a result of a slight expansion of its inner diameter, a slight axial displaceability of the sleeve is ensured because the same can slide much more easily with its at least one elastic insert along the webs thereof left between the recesses than in cases where the elastic insert has a smooth surface. Hence, the position of the sleeve on the mast can be changed quickly and easily after the clamping seat of the sleeve has been released so that the height of a wishbone boom on the mast of a sailboard is adjustable on water.

Another advantage of the elastic insert or inserts arranged according to the invention is that the same has/have a smaller weight due to the recesses thereof.

The recesses should be grooves which in the fastened position of the sleeve extend parallel to the longitudinal axis of the mast. This configuration is of advantage to an easy displacement of the sleeve in its released state because in this case the small webs extending parallel to the longitudinal axis of the mast practically form slide bearings between the grooves.

The cross-sectional width of the webs should decrease from the base thereof towards the free end; the webs can here be of a substantially roof-like cross-sectional configuration. The clamping effect is thereby increased in the fastened position of the sleeve, while an excellent displaceability is ensured in the released state of the sleeve.

According to the invention the insert also comprises at least one smooth portion on the inner surface facing the mast. This construction is especially expedient when a contact pressure is exerted on the mast through the insert over a small area to move the sleeve into a non-displaceable seat, as is the case with the wishbone-boom front piece of the invention wherein an eccentric located on the wishbone boom head engages through a window into the interior of the sleeve when the wishbone boom is pivoted into the in-use position. The insert is fastened inside the sleeve such that the window is covered by the smooth portion so that the contact force applied by the cam is transmitted through the smooth portion of the insert onto the mast. This construction has the advantage that the wear of the insert which would be very great in the case of a surface structure is reduced in the area of the eccentric. In this connection it is however pointed out that the protions which are provided with recesses and belong to the at least one elastic insert also transmit considerable retaining forces as they are also pressed against the mast. After the sleeve has been released by pivoting the cam back, the smooth portion does virtually not detract from the displaceability of the mast sleeve.

The insert should be made of rubber which should be as abrasion-resistant as possible and which guarantees an excellent clamping effect when there are small closing and contact forces. The rubber insert distinguishes itself by its extreme gentleness to the material of the mast.

According to another aspect of the present invention the lever of the mast sleeve has a predetermined intermediate opening position in which the pivotal movement thereof from the closing position in the opening direction is inhibited or stopped. A sudden opening of the sleeve is thereby prevented as the strong opening movement resulting from the prestress of the sleeve is blocked in the intermediate opening position so that the sleeve cannot spring open but remains closed in an expanded state which is now free from stresses.

It is here suggested that at least one head end of the lever which is hinged to the sleeve should have formed thereon a cam which in the intermediate opening position strikes against an adjacent outer wall portion of the sleeve, whereby the further pivotal movement of the lever is stopped as long as the force required for pivoting the cam beyond the intermediate opening position is not applied. The at least one cam and the adjacent outer wall portion should be matched to each other with regard to their form, mutual arrangement and material properties in such a way that the lever can be pivoted beyond the intermediate opening position into the opening position by the application of a relatively small force which should be adapted such that the sudden opening of the sleeve beyond the intermediate opening position is definitely prevented.

In the intermediate opening position the inner space of the sleeve can be expanded such that an axial displacement is possible along the mast, while the closing member of the lever means remains in engagement with the opposite end portion of the sleeve.

When this displaceability in the intermediate opening position is not given yet, the inner space of the sleeve can be expanded by further pivoting the lever beyond the intermediate opening position, this second opening step being so smooth because of the stress-free state of the sleeve that the closing member continues to remain in engagement with the associated end portion of the sleeve, i.e. the sleeve remains in the closed state. This is assisted by the mast pressing against the closing portion because of the sail tension towards the clew, which ensures the maintenance of the closing position.

The mast sleeve can be quickly and easily brought into a displaceable state by pivoting the lever into the intermediate opening position and then beyond this positon, if necessary, with the mast sleeve, which remains here in an entirely closed state, being still securely retained on the mast. Even if there is a strong wind, the surfer does not run the risk that the rig becomes useless when the changes the fastening height of the wishbone boom on water in the above-described manner.

Preferred embodiments of the invention will now be described in greater detail with reference to the drawing in which.

PREFERRED EMBODIMENT OF THE INVENTION

Figure 1:
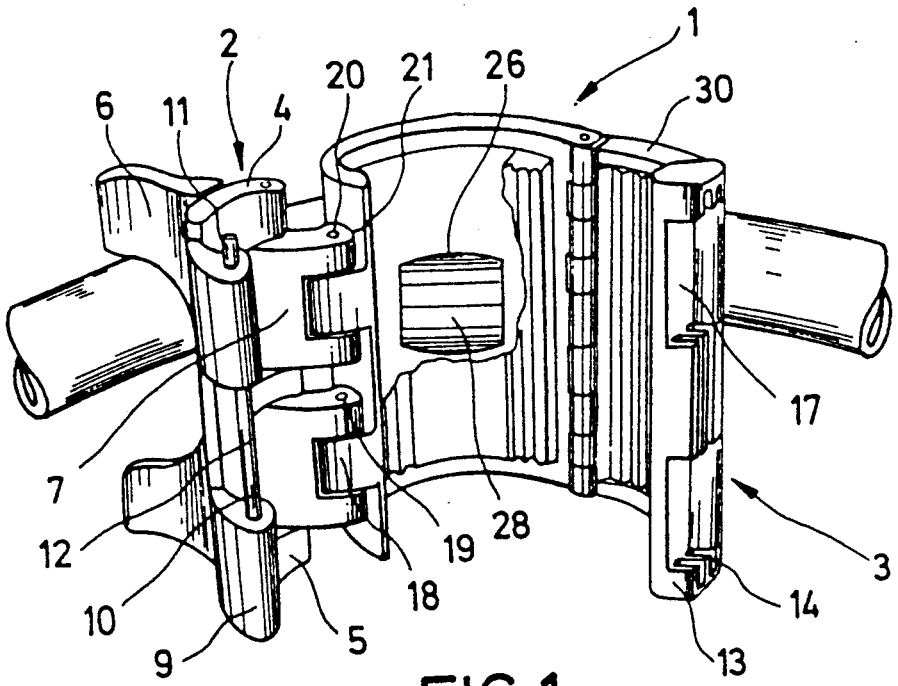
FIG. 1 is a perspective view of a wishbone-boom front piece of the invention with the mast sleeve being in the open state.

The mast sleeve 4 shown in the FIGS. is connected at one of its two lateral ends to a lever means 2 by which it is connectable in two different positions to a receiving means 3 connected to the other end of the mast sleeve. The lever means 2 includes a first lever 4 which is pivotally supported with three parallel, evenly spaced-apart fastening arms 5 about a common axis on another lever 7 which is provided with grip portions 6 and is, for its part, hinged to the outer side of the associated lateral end of the mast sleeve 1.

The three fastening arms 5 of the lever 4 are integrally connected through a connection portion 8 to two retaining arms 9 in which a common locking pin 10 is embedded such that the same projects at both axial ends over the retaining arms to form locking portions 11. The locking pin 10 forms a central locking portion 12 between the retaining arms 9. In the area of the retaining arms 9 the locking pin 10 is entirely embedded in the retaining arms, whereby the locking pin 10 is retained in a very solid way.

The receiving means 3 formed at the other end of the mast sleeve 1 includes at its upper and lower edges two strips 13 which extend in the circumferential direction of the mast sleeve and in which receiving grooves 14 are formed for the locking portions 11 of the locking pin 10. Relatively elongated webs 15 which define receiving grooves 16 aligned with the associated grooves 14 are centrally located between the strips 14. In the selected position the central locking portion 12 of the locking pin 10 is accommodated in one of said grooves 16. The receiving means 3 is designed such that two different widths of the mast sleeve can be adjusted.

The strips 13 and the webs 15 have provided thereinbetween two recesses 17 into which the front end portions of the retaining arms 9 enter such that the outer surface of the retaining arms 9 is substantially flushed with the outer surface of the strips 13, the webs 15 and the subsequent portion of the mast sleeve 1.

Figure 3:
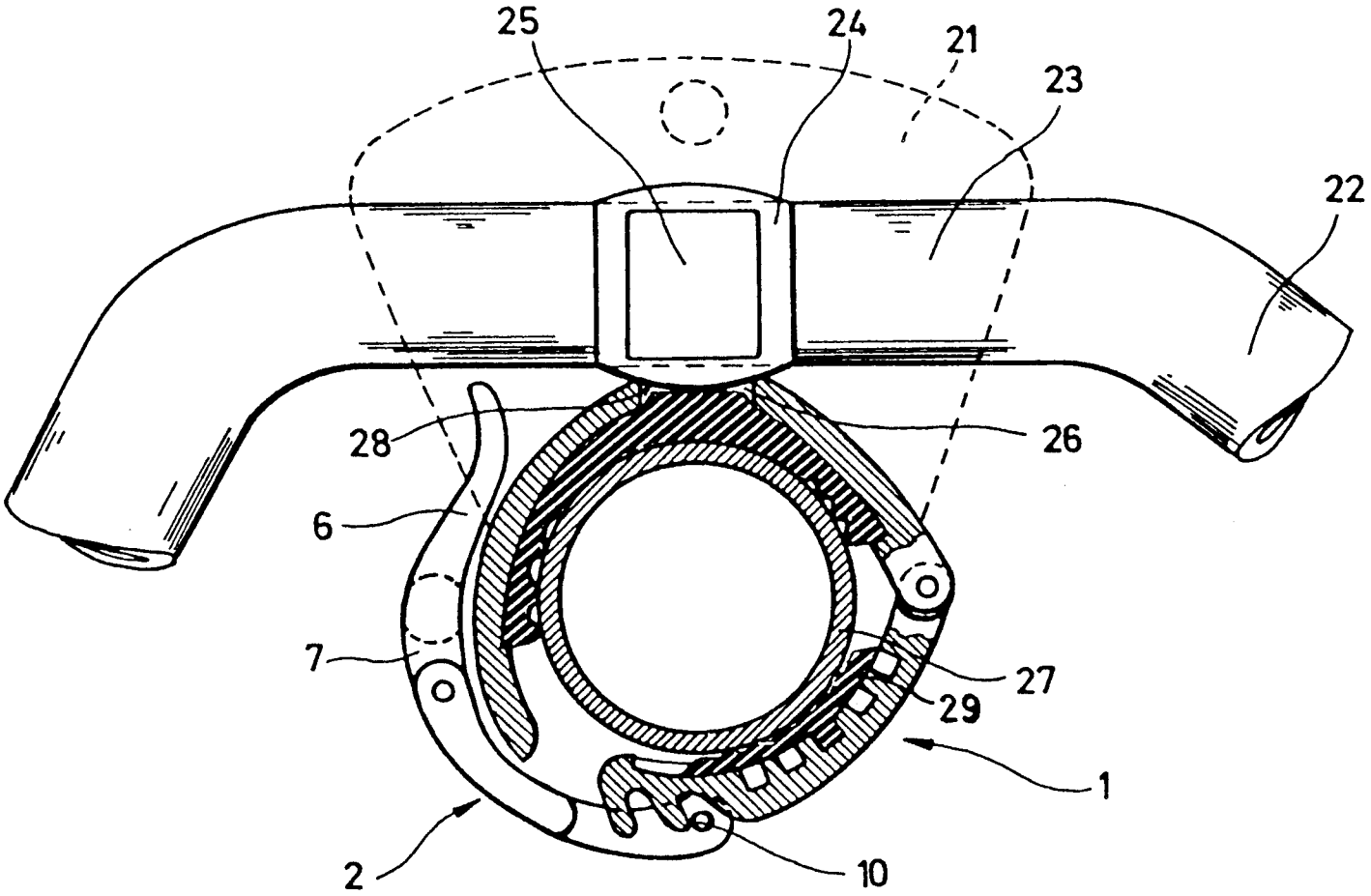
FIG. 3 is a partly sectional top view of the mast sleeve of FIG. 2.

As shown in FIG. 3, the grooves 14 and 16 extend, subsequent to their radially outer entrance opening, obliquely in the direction of the end of the mast sleeve 1 provided at the lever side, whereby entry of the locking portions 11, 12 into the grooves 14, 16 is facilitated when the mast sleeve 1 is closed, and the locking position is optimally secured. Moreover, owing to the oblique course of the grooves the locking position is maintained in an intermediate opening position of the lever means in which the inner space of the mast sleeve 1 is somewhat expanded, with the sleeve being still closed.

Figure 2:
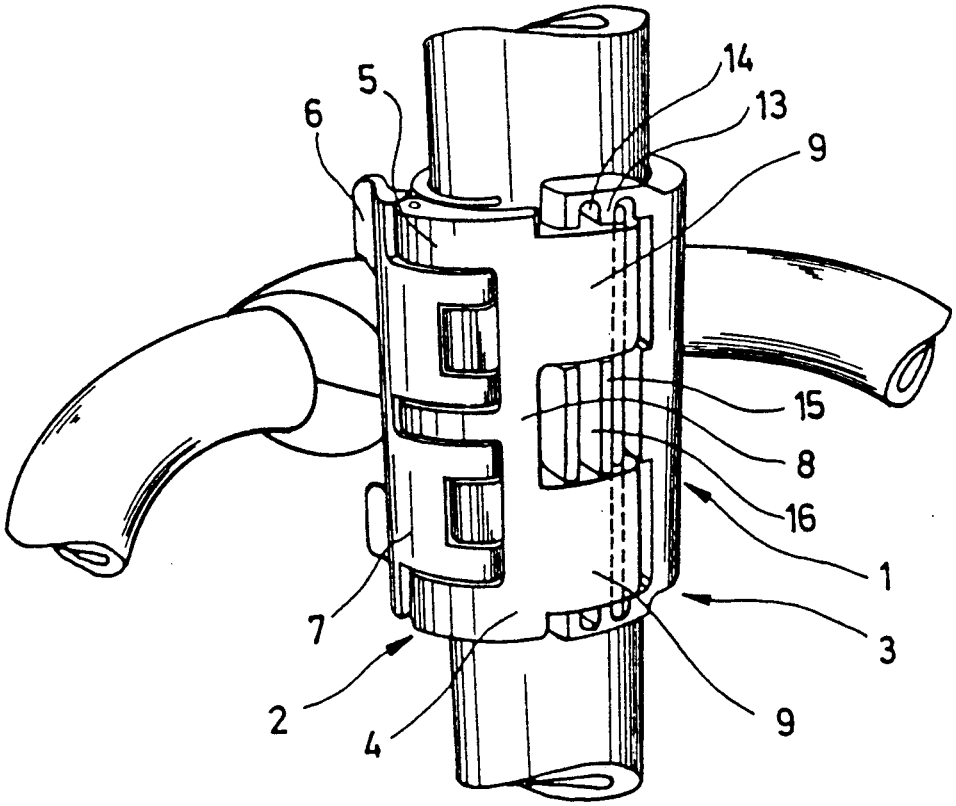
FIG. 2 is a perspective view of the front piece of FIG. 1 with the sleeve being closed.

As shown in FIG. 2, the lateral border edges of the retaining arms 9 substantially rest against the facing end faces of the strips 14 and the webs 15 in the closed state of the mast sleeve 1 so that a relative movement of the two lateral ends of the mast sleeve 1 is excluded in axial direction. The three fastening arms 5 of the lever 4 are received in recesses of the lever 7 such that the outer circumferential surface of the lever means 2 is smoothly rounded in the closed state, whereby and risk of injury is excluded.

To fasten the lever 7 to the mast sleeve 1, two bearing bodies 18 are formed on the outer side thereof, said bearing bodies holding bearing journals 19 on which the lever 7 is rotatably supported with four head ends 20. Each of the head ends 20 has formed thereon at 21 a cam which during the pivotal movement of the lever 7 from the closing position in the opening direction strikes against the associated wall surface of the mast sleeve 1 in such a way that the further pivotal movement of the lever is inhibited. An intermediate opening position of the lever means 2 in which the mast sleeve 1 is expanded is thereby defined, with the locking pin 10 remaining in the grooves in the selected position.

As outlined in FIG. 3, the mast sleeve 1 forms part of the wishbone-boom front piece 21 in which a wishbone boom 22 is rotatably supported with its wishbone boom pivot 23. The wishbone boom pivot 23 has fastened thereto a cam 24 which comprises a flattened portion 25 which is opposite a window 26 in the mast sleeve when the wishbone boom is arranged about parallel to the mast 27. With this configuration of wishbone boom 22 and mast 27 the mast sleeve 1 is closed by the lever means 2. When the wishbone boom 22 is subsequently pivoted into the in-use position perpendicular to the mast, the cam 24 engages with a convex cam path 28 into the window 26 of the mast sleeve 1 and presses a rubber insert 29 firmly against the mast, whereby the mast sleeve 1 is brought into an entirely non-displaceable clamping seat.

To facilitate the accommodation of the mast 27 in the mast sleeve 1, as well as the lateral removal thereof, a sleeve portion 30 is hingedly connected to the remaining mast sleeve so that the portion 30 can be pivoted outwards for expanding the opening, as illustrated in FIG. 1.

The locking pin consists of stainless steel, preferably $V_2A$ steel, while the mast sleeve is made of a suitable plastic material.

Figure 4:
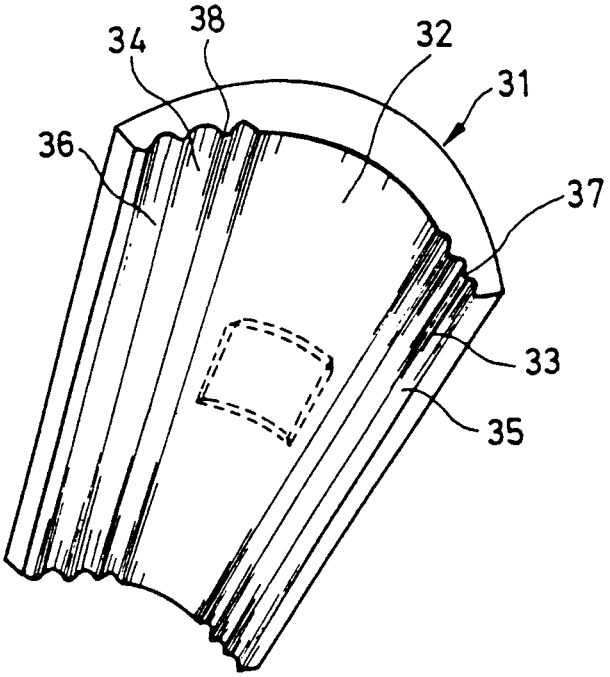
FIG. 4 is a perspective view of a first embodiment of an elastic insert having a central smooth inner wall portion.
Figure 6:
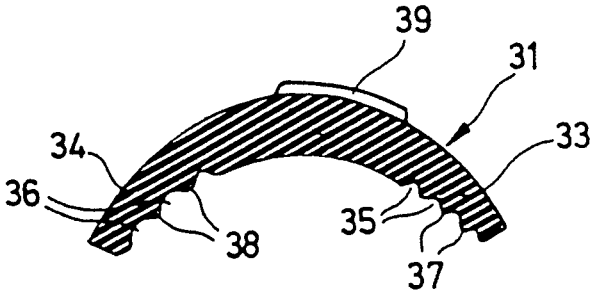
FIG. 6 is a section through the insert of FIG. 4.

FIG. 4 shows an elastic insert 31 whose inner surface facing a mast (not shown) in the mounted position comprises a central smooth portion 32 from which portions 33, 34 provided with a surface structure extend at both sides. This surface structure consists of grooves 35, 36 which extend in the longitudinal direction and between which small webs 37, 38, extending also in the direction of the longitudinal axis of the mast, are left. The smooth inner wall portion 32, the grooves 35 and 36, as well as the webs 37 and 38 respectively extend over the whole length of the elastic insert 31. As shown in FIGS. 4 and 6, the elastic insert is thicker in the area of the smooth inner wall surface than in the lateral structured portions. The grooves 36 of the structured portion 34 are greater in width than the grooves 35 of the other structured portion 33.

Figure 7:
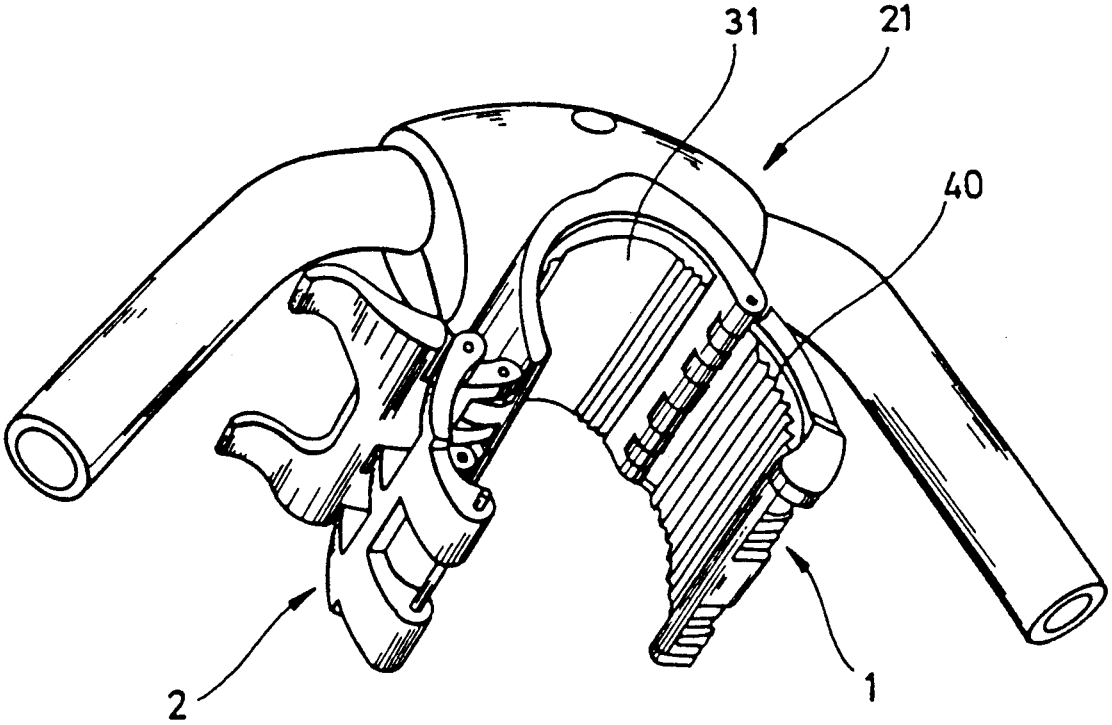
FIG. 7 shows the wishbone-boom head piece with the sleeve of the invention provided with the elastic inserts of FIGS. 4 through 6.

The back side of the insert 31 has formed thereon a shoulder 39 which is rectangular in top view and which when the insert 31 is fastened to the inner side of the sleeve 1 shown in FIG. 7, engages into a correspondingly formed window (not shown).

Figure 5:
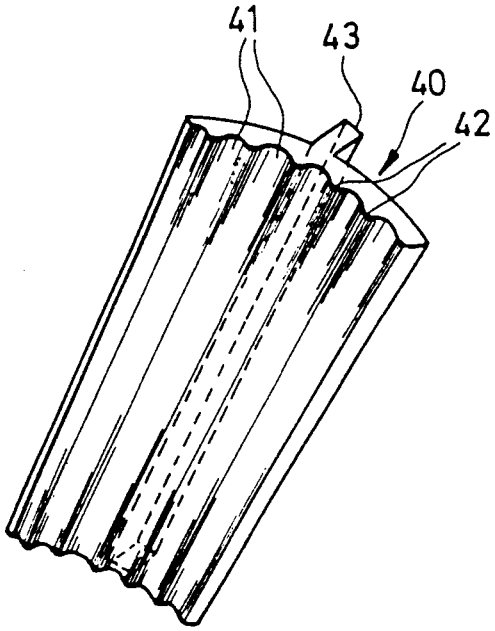
FIG. 5 is a second embodiment of an elastic insert without a smooth inner wall portion.

FIG. 5 shows another elastic insert 40 whose entire inner surface facing the mast (not shown) is structured. This structure consists again of grooves 41 which extend in the longitudinal direction of the mast and between which there remain small webs 42 which, like the grooves, extend over the whole length of the insert 40. The insert 40 has no smooth inner wall portion.

The back side of the insert 40 has formed thereon a web 43 which extends over the whole length of the insert and engages into corresponding groove for fastening the insert 40 to the inner wall of the sleeve 1. FIG. 7 shows the wishbone-boom front piece 21 comprising the sleeve 1 whose inner wall has recessed therein two circumferential portions into which at insert 31 and an insert 40 are fitted.

When the sleeve 1 is closed by means of the lever arrangement 2 around a mast and the wishbone boom is pivoted into the in-use position which is about perpendicular to the mast and in which the cam 24 presses the smooth portion 32 of the insert 31 against the mast, the webs 37, 38 and 42 of the two inserts 31, 40 are in firm contact with the circumferential surface fo the mast. Even with small closing forces the mast is thus put into an entirely non-displaceable clamping seat due to the great retaining force of the webs.

When the sleeve 1 is expanded by means of the lever arrangement 2, the sleeve can be axially displaced along the mast by applying a small force as the small webs only counter this displacement with small frictional forces.

When water and/or sand enters between the mast and the inserts 31, 40, it penetrates into the grooves 35, 36 and 41 in the structured portions of the inner surface of both inserts, whereby in the case of water the contact is improved and in the case of penetrating sand grains a spike effect and damage to the anodized protective layer of the mast are prevented.

To fasten the lever 7 to the end portion of the sleeve 1, the outer side thereof has formed thereon two superimposed bearing bodies 18 in which a respective bearing pin 19 is embedded such that the two axial ends thereof project s bearing journals, as best shown in FIG. 1. Each of said bearing journals has rotatably seated thereon a head end 20 of the lever 7, which thus comprises four of said head ends 20.

Figure 8:
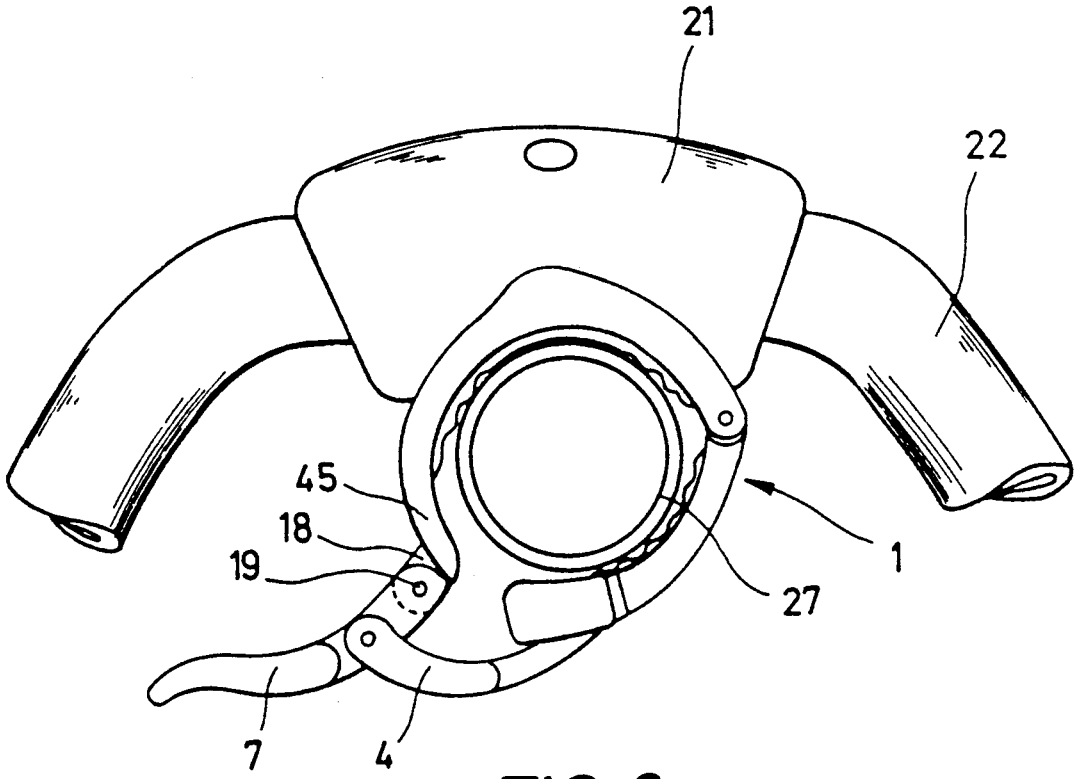
FIG. 8 is a top view of the wishbone-boom front piece with the lever arrangement being in the intermediate opening position.
Figure 9:
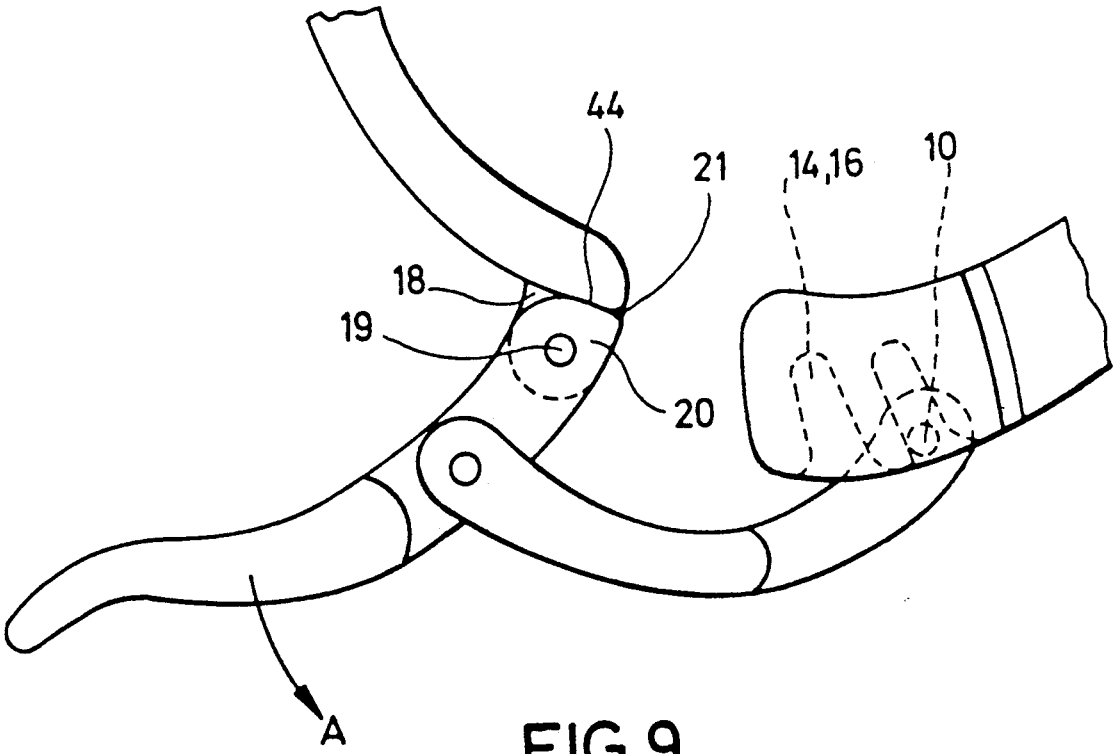
FIG. 9 is an enlarged view of the portion of the lever arrangement in the intermediate opening position.

Each head end 20 of the lever 7 comprises a cam 21 which in the intermediate opening position illustrated in FIGS. 8 and 9 strikes against an adjacent outer wall portion 44 of the sleeve in such a way that the further pivotal movement of the lever 7 from the closing position in the opening direction outlined by arrow A is inhibited, with the sleeve remaining with an expanded inner space in the closed state. This means that the pin 10 is still in engagement with the selected groove, which is assisted by the oblique course of the grooves from the radially outer entrance opening in the direction of the end portion 45 of the sleeve 1 provided at the lever side, as outlined in FIG. 8.

Figure 10:
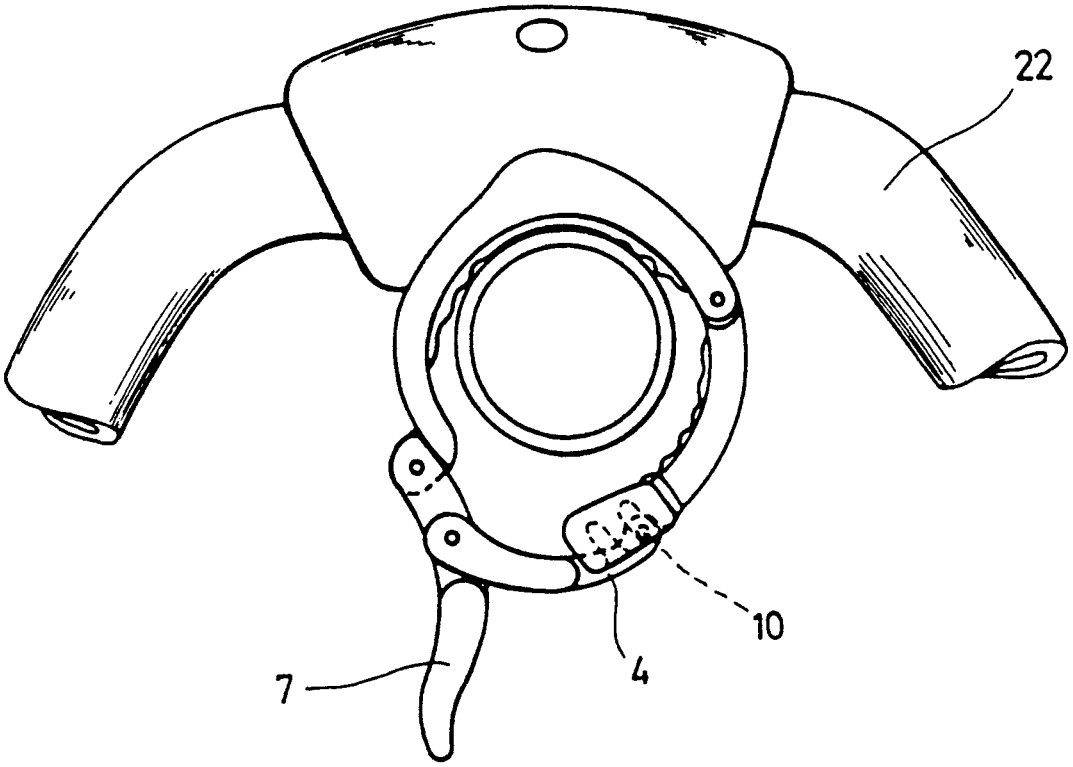
FIG. 10 is a view similar to that of FIGS. 8 and 9, but in the opening position of the lever with the sleeve being closed.
Figure 11:
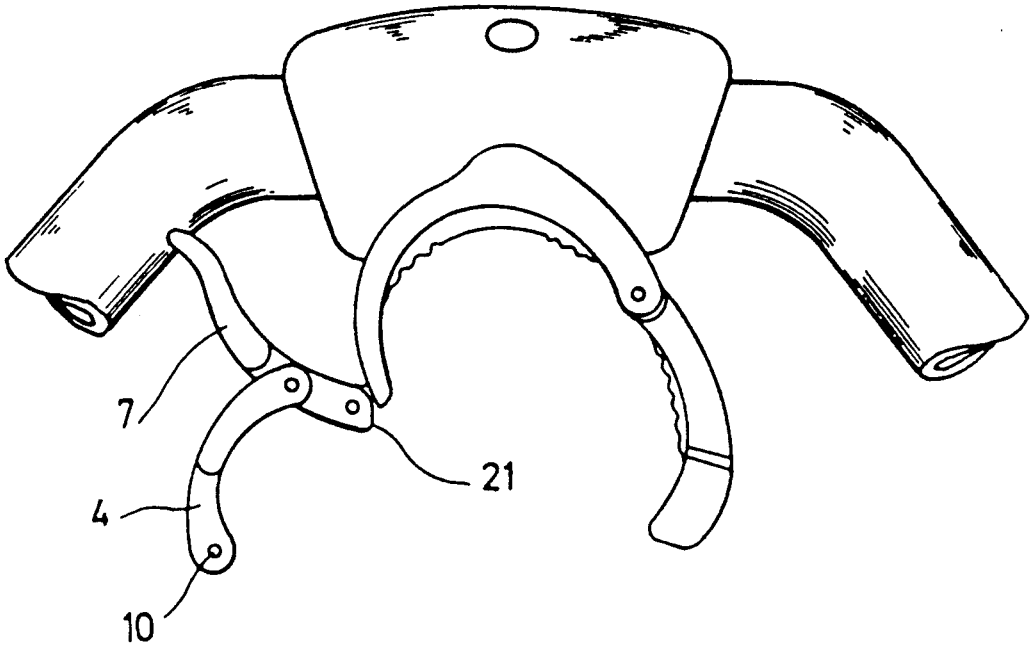
FIG. 11 shows the open position of the sleeve for receiving and releasing the mast.

The intermediate opening position can be overcome by applying a corresponding force, the cams 21 of the head ends 20 of the layer 7 pressing the associated wall portions 44 of the sleeve backwards, whereby the lever can be smoothly pivoted into the opening position shown in FIG. 10 without the sleeve springing open. By squeezing the sleeve, the same can be moved into the open positon shown in FIG. 11, in which the mast 27 can be received or released for lateral removal.

Owing to the two-step of the lever 7 the height of the wishbone boom 22 on the mast 27 can be changed in the rigged state on water because the internal dimensions of the sleeve 1 can be enlarged without the sleeve springing open so that the sleeve remains on the mast in the closed state while the pin 10 is being retained in the selected groove.

I claim:

1. A wishbone-boom front piece for fastening a wishbone boom to the mast of a surfboard, said wishbone boom being rotatably supported with its front wishbone boom pivot in said front piece, comprising a mast sleeve which surrounds said mast and, for the purpose of adaptation to different mast diameters, has two ends which face each other and are connectable at a selected distance from each other by a lever means hinged to one end of side mast sleeve, characterized in that said lever means includes a first lever which is pivotable about an axis parallel to the longitudinal axis of said mast sleeve and comprises on its free end portion at least one locking pin which is fastened to said lever in such a way that it projects with locking portions in both axial directions, and that the other end of said mast sleeve is provided with a receiving means comprising receiving openings that are spaced from each other in the circumferential direction of said mast sleeve and are intended for said locking pin, said receiving means comprising at least two axially spaced-apart strips which extend in the circumferential direction of said mast sleeve and have recessed therein aligned receiving grooves for said locking portions which starting form their radially outer entrance opening obliquely extend in the direction of the end of said mast sleeve provided at the lever side.

2. The wishbone-boom front piece according to claim 1, characterized in that at least one recess for receiving said free end portion of said lever is provided between said strips of said receiving means in such a way that the outer surface of said lever in the closing position is substantially flush with the outer surface of the subsequent portion of said mast sleeve.

3. The wishbone-boom front piece according to claim 1, characterized in that said lever comprises two parallel, axially spaced-apart retaining arms to the free end portions of which one of a pair of locking pins is fastened to each arm, respectively such that said locking pins are in alignment with each other.

4. The wishbone-boom front piece according to claim 1, characterized in that relatively elongated webs which define receiving grooves in alignment with the associated receiving grooves of said strips are centrally formed on said receiving means between said two strips.

5. The wishbone-boom front piece according to claim 4, characterized in that the cross-sectional width of said webs decreases from the base to the free end, said webs being of a substantially roof-like cross-sectional configuration.

6. The wishbone-boom front piece according to claim 1, characterized in that said lever comprises three parallel, evenly space-apart fastening arms which are pivotally hinged about a common axis to another lever which is provided with grip portions and supported to said mast sleeve, said fastening arms being integrally connected to both of said retaining arms through a connection portion.

7. The wishbone-boom front piece according to claim 6, characterized in that in the closing position of said lever means said fastening arms are received in corresponding recesses of said other lever in such a way that the outer surface of said fastening arms is flush with that of said other lever.

8. The wishbone-boom front piece according to claim 1, characterized in that a circumferential portion of said mast sleeve is pivotally hinged to the remaining mast sleeve about an axis parallel to the longitudinal axis of said mast sleeve.

9. The wishbone-boom front piece according to claim 1, characterized in that at least one circumferential portion of the inner surface of said mast sleeve has fastened thereto at least one insert which consists of rubber and whose inner surface facing said mast comprises recesses.

10. The wishbone-boom front piece according to claim 9, characterized in that said recesses are grooves which in the fastened position of said sleeve extend parallel to the longitudinal axis of said mast, that small webs extend between said recesses, and that the inner wall of said sleeve corresponding substantially to the outer circumference of said mast has recessed therein at least one circumferential portion in which said at least one insert can be accommodated such that the webs thereof are pressed against said mast in the fastened position of said sleeve.

11. The wishbone-boom front piece according to claim 10, characterized in that said grooves extend over the whole length of said insert.

12. The wishbone-boom front piece according to claim 9, characterized in that said insert additionally comprises at least one smooth portion of the inner surface facing said mast, with a respective portion, which comprises said recesses, extending from both sides of said smooth portion, and that said insert is thicker in the area of said smooth portion than in the area of said respective portions provided with recesses.

13. The wishbone-boom front piece according to claim 12, characterized in that the outer side of one end portion of said sleeve has formed thereon two preferably super-imposed spaced bearing bodies in which a respective bearing pin is embedded, said bearing pin projecting at both axial ends as a bearing journal over said bearing body, and that an associated head end of said lever is rotatably seated on each of said bearing journals.

14. The wishbone-boom front piece according to claim 1, characterized in that said mast sleeve comprises an insert having at least one smooth inner wall portion, and at least one further insert without a smooth inner wall portion.

15. The wishbone-boom front piece according to claim 1, characterized in that said first lever is hinged to another lever which is pivotally fastened about a longitudinal axis of said sleeve to a first lateral end portion of said sleeve, the later being closable by placing said other lever around the outer side of said sleeve, and said sleeve being adapted to be opened when said other lever is pivoted into an opening position, and that said other lever is provided with an intermediate opening position in which the pivotal movement thereof from the closing position in the opening direction is inhibited, while said sleeve remains with an expanded inner space in the closed state.

16. The wishbone-boom front piece according to claim 15, characterized in that at least one hinged head end of said other lever has formed thereon a cam which in the intermediate opening position strikes against an adjacent outer wall portion of said sleeve, said at least one cam and said adjacent outer wall portion being matched to each other such that said lever is pivotable beyond said intermediate opening position into said opening position.

17. The wishbone-boom front piece according to claim 16, characterized in that one end portion of said sleeve can be deformed elastically so that its outer wall portions can be forced out of the movement path of said cams.

18. The wishbone-boom front piece according to claim 15, characterized in that said first lever is hinged to an intermediate portion of said other lever between the two ends thereof.

19. The wishbone-boom front piece according to claim 15, characterized in that said wishbone boom pivot has fastened thereto a cam which with a flattened portion is opposite a window in said mast sleeve when said wishbone boom is arranged about parallel to said mast, and that said cam engages with a convey cam path into the window of said mast sleeve to press a rubber insert firmly against said mast when said wishbone boom is pivoted into the in-use position perpendicular to said mast.

* * * * *